United States Patent [19]

Blot

[11] Patent Number: 4,714,232

[45] Date of Patent: Dec. 22, 1987

[54] BEARING RING FOR FIXING A MOUNTING BLOCK ON THE PROGRESSIVELY VARIABLE CURVED FINISHED FACE OF A SEMI-FINISHED LENS OR MOLD BLANK

[75] Inventor: Gérard Blot, Draveil, France

[73] Assignee: Essilor International Cie Generale d'Optique, Creteil, France

[21] Appl. No.: 824,562

[22] Filed: Jan. 23, 1986

[30] Foreign Application Priority Data

Feb. 1, 1985 [FR] France ..... 85 01422

[51] Int. Cl.[4] ..... B24B 4/06

[52] U.S. Cl. ..... 249/90; 51/216 LP; 164/332; 248/DIG. 12; 249/96; 425/808

[58] Field of Search ..... 249/90, 91, 96, 83, 249/187; 425/110, 127, 266, 412, 411, 808, DIG. 129; 51/277, 284 R, 216 LP; 29/527.1, 527.5; 164/108, 110, 332, 333, 334; 264/1.1; 220/287; 248/346, 309.1, DIG. 12

[56] References Cited

U.S. PATENT DOCUMENTS

| | | | |
|---|---|---|---|
| 2,545,447 | 3/1951 | Clement | 51/131 |
| 3,140,568 | 7/1964 | Beasley | 51/216 |
| 3,304,586 | 2/1967 | Buckminster et al. | 164/332 |
| 3,330,331 | 7/1967 | Duckwall | 164/112 |
| 3,512,310 | 5/1970 | Rudd et al. | 51/277 |
| 3,866,660 | 2/1975 | Gill | 51/216 LP |
| 3,951,203 | 4/1976 | Prunier | 164/334 |
| 4,089,102 | 5/1978 | Soper et al. | 29/527.5 |
| 4,118,853 | 10/1978 | Mignem | 29/527.1 |
| 4,190,621 | 2/1980 | Greshes | 425/808 |

FOREIGN PATENT DOCUMENTS

| | | |
|---|---|---|
| 630402 | 10/1949 | United Kingdom . |
| 1155719 | 6/1969 | United Kingdom . |

*Primary Examiner*—Jay H. Woo
*Assistant Examiner*—J. Fortenberry
*Attorney, Agent, or Firm*—Charles E. Brown; Charles A. Brown

[57] ABSTRACT

This bearing ring is of the kind comprising, for contact with the semi-finished blank to be processed, a limited number of bearing areas appropriately distributed circumferentially around the axis of the assembly. The planes tangential to the ends of each of the bearing areas form between them a dihedron, the bearing surface that a bearing area of this kind provides being in practice generally convex.

14 Claims, 8 Drawing Figures

BEARING RING FOR FIXING A MOUNTING BLOCK ON THE PROGRESSIVELY VARIABLE CURVED FINISHED FACE OF A SEMI-FINISHED LENS OR MOLD BLANK

The present invention is generally concerned with ophthalmic lenses usually called progressive.

As is known, these are ophthalmic lenses of which one side at least features a progressively variable curvature over part at least of at least one meridian line in order to achieve a progressive increase in refractive power along the latter.

In practice this applies only to the front, convex face of an ophthalmic lens of this kind, and the lens is usually characterized, on the one hand by its basic curvature, to which there corresponds an area of far sight for the patient concerned and, on the other hand, by its additional refractive power to which there corresponds an area of near sight for the patient concerned.

Conjointly with this, the rear, concave face of progressive ophthalmic lenses is governed by possible specific prescription curves required in order to correct the sight of a patient.

Given, on the one hand, the difficulty of producing progressively variable curved surfaces and, on the other hand, the diversity in terms of nature and intensity of other possible sight corrections, it is more economical to produce a limited number of semi-finished blanks with their front face, which then constitutes a finished face, covering a determined range of basic curvature and additional refractive power, considered sufficient to correspond to all foreseeable situations, and subsequently to adapt these blanks by machining their rear face according to the various prescription curves that may be required.

For the further machining that must then be carried out on the rear face of such semi-finished blanks, it is usable to attach to their front face, by means of a process involving casting a low melting point metal, a handling block, usually called a mounting block, adapted to appropriately support it on a surfacing machine.

To produce a mounting block of this kind it is usual, within a blocking device, to cast a low melting point material between the face in question of the semi-finished blank to be processed and a bell-shaped mold, usually called a bearing ring, the open side of which faces towards the blank.

In this situation there is a two-fold problem.

Firstly, to guarantee the precision of subsequent surfacing operations and thus to provide for obtaining a finished ophthalmic lens having the required optical characteristics, it is essential to provide for precise positioning of the finished face of the semi-finished blank to be treated relative to the bearing ring employed.

As previously indicated, this finished face features progressively variable curvature which, if no other measures are applied, may randomize its bearing engagement on the bearing ring.

In particular, this can result in the uncontrolled formation of a greater or lesser prism section in the near sight area to which this progressively variable curvature corresponds, and thus to difficulties with matching ophthalmic lenses for the same patient.

Also, it is desirable for the same blocking device to be used for all the semi-finished blanks to be treated.

More often than not there is used with this end in view an adapter ring one side of which, the bearing side, is annularly shaped so as to be able to lie against the finished face of a semi-finished blank to be processed, while the other is adapted to operate with the mold or bearing ring employed.

A solution such as this makes it necessary to provide a sizable number of adapter rings with different characteristics, each corresponding to the entire range of semi-finished blanks to be processed.

In practice, this requires one adapter ring per basic curvature and per additional refractive power, frequently representing a total of around 30 adapter rings for each type of progressive ophthalmic lens.

Apart from the resulting storage difficulty, this solution is all the more costly in that each of the adapter rings used is usually a metal ring produced by machining and therefore expensive.

To minimize this disadvantage it has been proposed to use, instead of these adapter rings, mounting armatures that can be made in a synthetic material, these mounting armatures being disposable and, at the time the mounting block is cast, at least partially embedded in the mounting-block.

Although a solution of this kind, which is the subject matter of the French patent filed May 29, 1972 under application No. 72 19131 and published under the No. 2,186,441, has given and may still give satisfaction, it also leads to the necessity to maintain a significant number of mounting armatures corresponding to the various basic curvatures and additional refractive powers for each type of progressive ophthalmic lens.

Another solution already proposed is to employ not rings or armatures adapted to provide a circumferentially continuous bearing area for the finished face of the semi-finished blank to be processed, but simply studs which, applied against the finished face locally, define for this face a limited number of bearing areas appropriately distributed circumferentially around the axis of the assembly.

Depending on the basic curvature and the additional refractive power, two of these studs or compensator studs are applied in this way to the periphery of the finished face, disposed at respective opposite ends of the horizontal diameter of the latter, so that the finished face as a whole bears on three points and thus on a plane, the third point, which is on a circular half-ring passing through the other two, not entailing the use of any compensator stud.

Although it is economical, this solution has the disadvantage that a semi-finished blank to be processed is supported only on a half-circle, which may give rise to errors leading inevitably to rejection of the finished ophthalmic lenses subsequently obtained.

A general object of the present invention is an arrangement which, while meeting the conditions imposed, offers the advantage of making it possible to circumvent these disadvantages.

More precisely, the object of the present invention is a bearing ring for a semi-finished blank such as an ophthalmic lens or a mold to be used for molding an ophthalmic lens, of the kind comprising, for the purpose of contact with said semi-finished blank, a limited number of bearing areas which, appropriately distributed circumferentially around an axis, are all generally inclined relative to a reference plane perpendicular to this axis, each extending between two ends offset both radially and axially relative to each other, this bearing ring being generally characterized in that the planes tangential to the ends of each of the bearing areas, both orthogonal to the same axial plane of the assembly passing through the median radius of a bearing area of this kind, form between them a dihedron.

The present invention is founded on the observation, not previously made in respect of a bearing ring, that by virtue of the inherent topography of the progressively variable curvature surfaces a limited number of bearing areas disposed on the same circle whose diameter depends on the basic curvature of this surface may be sufficient.

In practice, three bearing areas may be sufficient, without it being necessary for two of them to be disposed at the ends of the same diameter.

To the contrary, they are advantageously disposed at the corners of an isosceles triangle each side of which is spaced from the center of the corresponding circle, surrounding the latter.

Be this as it may, in accordance with the invention the planes tangential to the ends of each of the bearing areas used form between them a dihedron.

In other words, the inclination of a bearing area of this kind is not the same at both ends.

In a first embodiment, this inclination varies discontinuously from one end to the other of a bearing area.

In a case such as this, each of the bearing areas employed comprises in practice a plurality of bearing facets which, all generally inclined relative to the reference plane and all orthogonal to the axial plane of the assembly passing through the median radius of a bearing area of this kind, are differently inclined relative to said reference plane, said bearing facets succeeding one another radially on circumferences of different diameter according to their inclination, those at the ends being coincident with the tangential planes at the corresponding ends.

In practice, in order to cover all feasible basic curvatures, a limited number of such bearing facets is sufficient for each of the bearing areas employed, each of these bearing facets matching one or more of these basic curvatures.

Taken together, these multiple bearing facets form between them a generally convex assembly.

However, and in accordance with a second embodiment of the invention, a single bearing facet may suffice for each of the bearing areas employed.

In this case, this single bearing facet is, in accordance with the invention, continuously curved from one end to the other of a bearing area of this kind.

In other words, the inclination of a bearing area of this kind then varies continuously from end to the other.

The sale bearing facet is in practice a convex facet.

In all cases, multiple facets or curved single facets, whereas it was previously the usual practice to provide for the finished face of a semi-finished blank to be processed to bear on a ring or an armature the shape of which is complementary to that of this face and which therefore lies against the latter, in accordance with the invention appropriately implemented and generally convex facets suffice.

As a corollary to this, for the same basic curvature the length of the principal median of the triangle through which the finished face of a semi-finished blank to be processed bears on a bearing ring in accordance with the invention is substantially constant, whatever the additional refractive power of the blank, the point of contact with each of the corresponding bearing facets being simply displaced radially and/or circumferentially along a bearing facet of this kind, according to the additional refractive power.

The overall result of all this is that, for a given topography of the progressively variable curvature surface, that is to say for a particular type of progressive ophthalmic lens, a single bearing ring with a limited number of bearing areas may advantageously and economically prove satisfactory, in accordance with the invention, for processing the complete range of semifinished blanks with the various basic curvatures and additional refractive powers to be taken into consideration for producing such progressive opthalmic lenses.

According to the basic curvature of the finished face of a semi-finished blank of this kind, its bearing engagement on the bearing ring in accordance with the invention is on one or other of the bearing facets that each of the bearing areas of the ring comprises, in the case of bearing areas with multiple bearing facets, or at one or other point on the bearing facet of these bearing areas in the case of bearing areas with a single bearing facet, and, according to the additional refractive power of this semi-finished blank, the corresponding point of contact simply moves radially and circumferentially.

In all cases, the appropriate contact occurs tangentially and, provided that it is lined up with the markers provided for this purpose, the fitting to a hearing ring in accordance with the invention of a semi-finished blank to be processed may be systematically achieved with all the desired precision.

In particular, it is possible if required to orient the blank so that the plane tangential to the highest point on its finished face is at a determined angle to a reference plane proportional to its additional refractive power.

However, whatever may be the case with regard to this angle, the precision of the positioning thus achieved guarantees that of the optical characteristics finally obtained after machining the blank.

Likewise, with an off-center semi-finished blank, that is to say a semi-finished blank whose optical axis is offset transversely relative to the geometrical axis, it is sufficient when using the bearing ring in accordance with the invention to place the semi-finished blank on a bearing ring so that it is oriented appropriately relative to the ring.

It is then observed that the points at which the off-center semi-finished blank bears on the bearing ring are no longer at the corners of an isosceles triangle, as is the case with a semi-finished blank whose optical axis is coincident with the geometrical axis.

However, and advantageously, no special adjustment is then required to the surfacing machine subsequently used.

In other words, when the bearing ring used to make a mounting block on a semi-finished blank is a bearing ring in accordance with the invention, the settings of the surfacing machine remain the same whether the semi-finished blank has coincident optical and geometrical axis or is an off-center semi-finished blank.

Moreover, using only a few bearing facets and these having in principle simple plane, spherical or toroidal surfaces, for example, the bearing ring in accordance with the invention is advantageously relatively simple and economical to manufacture.

British Pat. No. 1 155 719 describes an ophthalmic lens retaining block which, for the purposes of contact with the ophthalmic lens, features a plurality of isolated bearing areas appropriately distributed in the circumferential direction, each of which extends between two ends offset relative to each other radially and axially.

However, apart from the fact that a holding block of this kind does not constitute a bearing ring in the sense of the present application, as it is not a part to be employed for making a mounting block but a part adapted to ensure of itself the retention of the ophthalmic lens while it is being surfaced, there is only provision for its bearing engagement with a cylindrical or toroidal surface and not for its bearing engagement on an aspherical surface such as is constituted by a progressively variable curvature surface and, because of this, although there is only one bearing facet per bearing area, this is in practice a plane bearing surface, the problem of adapting it to a range of different base curvatures and/or different additional refractive powers not arising.

The same does not apply to the bearing ring in accordance with the invention.

Likewise, in U.S. Pat. No. 3140568 it is a question of bearing areas which are adapted to lie against a spherical surface and, what is more, this spherical surface is convex so that the bearing facet that they form is a concave facet.

The characteristics and advantages of the invention will emerge from the following description given by way of example with reference to the appended schematic drawings in which.

Figure 1:
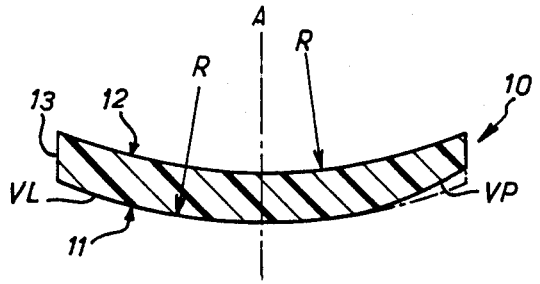
FIG. 1 is a view in axial cross-section of a semi-finished blank for a progressive ophthalmic lens.

As shown by FIG. 1, the semi-finished blank 10 of a progressive opthalmic lens is generally watchglass-shaped and its front face 11, which is in practice the convex face, is that featuring along at least one part of at least one of its meridians, assumed to that in the plane of the figure, a progressively variable curvature.

For example, and as shown, the face 11 of this semi-finished blank 10 may be generally spherical over a portion VL of its surface, assumed to correspond to the far sight of the patient concerned, whereas for the other portion VP of this surface, assumed to correspond to the near sight of the patient, it features along at least its principal meridian a progressively variable curvature.

Thus, and as schematically shown in chain-dotted line in FIG. 1, along its central meridian the portion VP of the surface of the front face 11 of the semi-finished blank 10 progressively recedes from the spherical surface otherwise constituting the other portion VL of this surface.

Be this as it may, the front face 11 of the semi-finished blank 10 that features progressively variable curvature constitutes its finished face.

It is thus its convex, rear face 12 which has to be machined to a prescription curve.

As shown, this rear face 12 may be a spherical face the radius R of which is equal to that of the far sight portion VL of the front face 11.

This arrangement is not imperative, however, as will be readily understood.

Also, it is not of relevance to the present invention.

The contour of the thus constituted semi-finished blank 10 is usually circular and the corresponding edge 13 of this blank is usually cylindrical, with generatrices parallel to the optical axis A of the assembly.

Figure 2:
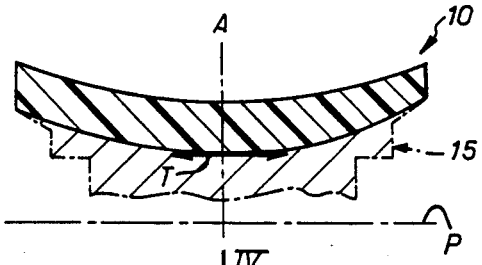
FIG. 2 is a view in axial cross-section which, like that of FIG. 1, shows the fitting of a mounting block to a semi-finished blank of this kind.
Figure 3:
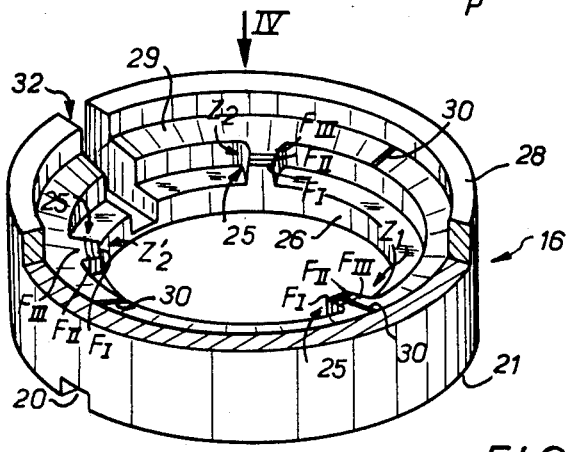
FIG. 3 is a cut away view in perspective of a bearing ring adapted in accordance with the invention for casting a mounting block of this kind.

This optical axis A, which is schematically represented in chain-dotted line in FIGS. 1 and 2, usually passes through the optical center of each of the faces 11 and 12.

For machining the rear face 12 it is necessary to attach a mounting block 15 to the front face 11, by casting a low melting point metal, as schematically shown in chain-dotted outline in FIG. 2, this mounting block 15 being designed for fitting the semi-finished blank 10 concerned to an appropriate surfacing machine.

To achieve good control over such positioning, it is important that the plane P tangential to the highest point on the front face 11, that is to say the tangential plane perpendicular to the optical axis A containing the optical center of this face 11, is in a particular orientation relative to a reference plane P.

In FIG. 2, in which the tangential plane T and the reference plane P are both schematically represented, in full line for the former and in chain-dotted line for the latter, the tangential plane T is assumed to be parallel to the reference plane P.

As a result, the optical axis A is then itself perpendicular to this reference plane P.

However this is not necessarily the case, as any required orientation is equally possible.

For casting the mounting block 15 it is necessary to place the semi-finished blank 10 on a bearing ring 16.

In the known manner the bearing ring 16 in accordance with the invention used for this purpose comprises an annular ring 17 with an axis A'.

Figure 5:
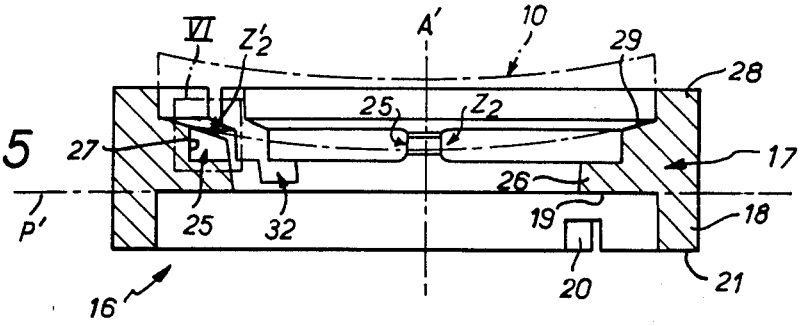
FIG. 5 is a view of it in axial cross-section on the broken line V—V in FIG. 4.
Figure 4:
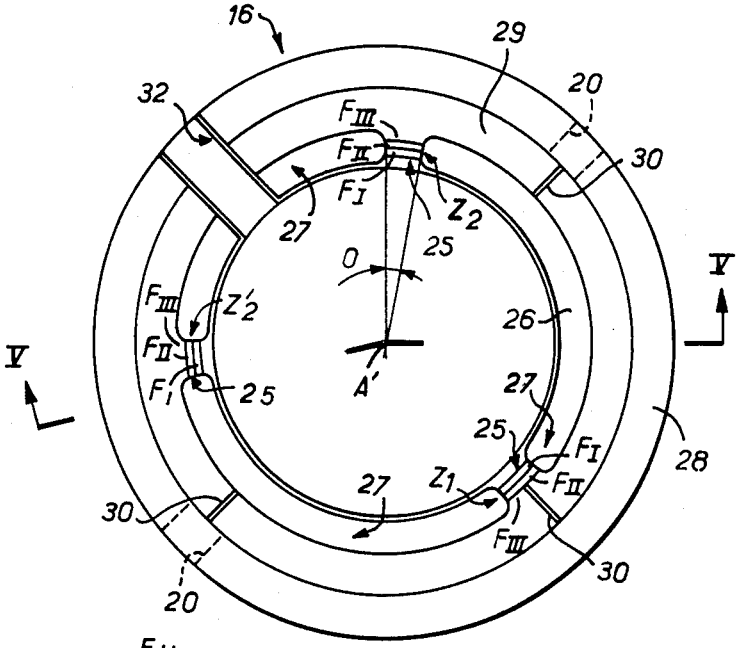
FIG. 4 is a plan view of this bearing ring, as seen in the direction of the arrow IV in FIG. 3.

This axis A' is schematically represented in chain-dotted line in FIG. 5 and its position is also shown in FIG. 4.

This ring 17 is extended axially by a skirt 18 on the side opposite that on which the semi-finished blank 10 to be processed is to bear, that is to say the lower side.

Inside the skirt 18 the ring 17 comprises a transverse plane support surface 19 perpendicular to the axis A' of the assembly.

This surface 19 constitutes a reference plane P' used to monitor the position of the bearing ring and thus that of the semi-finished blank 10 to be processed in the blocking device employed for casting the mounting block 15.

The skirt 18 comprises at least one notch 20 in its edge 21 for controlling the angular orientation of the bearing ring 16 about its axis A' in the blocking device.

In the embodiment shown two notches 20 are provided in this way in the edge 21 of the skirt 18, at diametrally opposite positions.

In this embodiment the outside surface of the skirt 18 is continuous with that of the ring 17 of which it forms an extension and its thickness in the radial direction is less than that of the skirt, being approximately half this thickness, for example.

On the side opposite the skirt 18, that is to say the upper side, a limited number of bearing areas Z are provided for contact with the semi-finished blank 10 to be processed: in practice three such bearing areas Z1, Z2, Z'2 are provided in this way.

These bearing areas Z are appropriately distributed circumferentially around the axis A'.

For example, and as shown, relative to one of them, the bearing area Z1 assumed to constitute a central bearing area, the two bearing areas Z2, Z'2, assumed to constitute lateral bearing areas may be disposed symmetrically relative to each other relative to an axial plane of the assembly passing through the median radius of the central bearing area Z1.

In practice the bearing areas Z each form the upper face of studs 25 projecting radially towards the axis A' of the assembly relative to the ring 17 common to said assembly.

At their base they are linked to each other by a collar 26 which, like them, projects radially from the ring 17 in the direction towards the axis A' of the assembly.

This collar 26, which is substantially perpendicular to said axis, extends in practice to the base of the ring 17, where the latter merges with the skirt 18.

It is in practice its lower surface which forms the bearing surface 19 constituting the reference plane P'.

Facing the ring 17 and the collar 26, the studs 25 carrying the bearing areas Z are separated from each other by recesses 27 whose slightly tapering mean right-angle axial profile faces upwardly, in the direction away from the skirt 18.

Projecting axially upwards relative to the studs 25 carrying the bearing areas Z, the ring 17 comprises in the embodiment show an extension 28 which extends substantially annularly around the axis of the assembly, in line with the skirt 18, and which like the skirt has a thickness in the radial direction substantially half that of the ring 17, with its outside surface continuous with that of the ring.

Where it merges with this extension 28, the ring 17 forms, inside the volume delimited by this extension, an annular land 29 which merges continuously with the upper face of each of the studs 25 carrying the bearing areas Z and which is overall inclined relative to the reference plane P', getting closer this reference plane P' as it gets closer to the axis A' of the assembly.

This annular land 29 is used to position markers 30.

In practice these are simply lines engraved radially on the surface of the annular land 29.

Three lines 30 are provided in this way.

One is in line with the meridian radius of the central bearing area Z1 and the others are each at 90° to the former, one on each side thereof, and aligned with each other.

There is provided in the thus constituted bearing ring 16 at least one localized notch 32 generally radially disposed in the embodiment shown which cuts not only into the ring 17 and its upward axial extension 28, but also, relatively deeply, into the collar 26 present internally at the bace of this ring 17, thus intersecting transversely the corresponding recess 27.

In the embodiment shown, only one such notch 32 is provided, being substantially radially disposed facing the central bearing area Z1.

The bearing areas Z are all generally inclined relative to the reference plane P', each extending between two ends $E_B$, $E_H$ offset radially and axially relative to each other.

The end $E_H$ or top end is radially located on a circumference of greater diameter than the circumference on which is located the end $E_B$ or bottom end and, in the axial direction, it is at a higher level than the reference plane P'.

In practice, the end $E_H$ of a bearing area Z is at the point where the corresponding stud 25 merges with the ring 17 and its end $E_B$ forms the free edge of this stud 25.

In accordance with the invention the planes $T_B$, $T_H$ tangential to the ends of each of the bearing areas Z, both orthogonal to the same axial plane of the assembly passing through a median radius of a bearing area Z of this kind, form between them a dihedron D.

Figure 6:
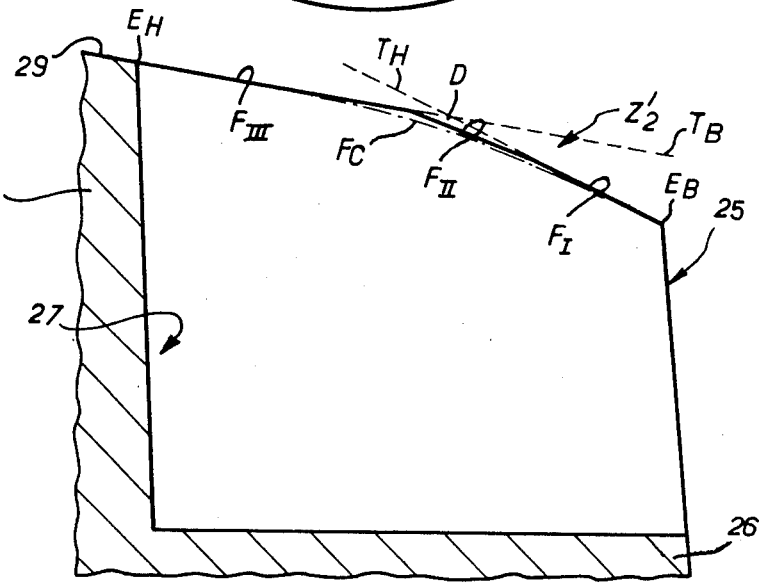
FIG. 6 shows to a larger scale the detail of FIG. 5 marked by the box VI on the latter.

These tangential planes $T_B$, $T_H$ are schematically shown in FIG. 6 (to avoid excessive shading in this figure the corresponding cross-section plane passes outside the stud 25 concerned; in reality it should be considered as passing through the median area of the latter).

The tangential planes do not necessarily contain within the totality of their length the corresponding ends $E_B$, $E_H$, these not necessarily being plane and/or not necessarily extending in their plane; they are simply planes which, tangential to the bearing area Z in question, are at least in contact with the latter at the intersection of its ends $E_B$, $E_H$ with the axial plane of the assembly passing through its median area or, in other words, through its median radius.

In practice, the concave side of the dihedron D formed by the tangential planes $T_B$, $T_H$ faces towards the reference plane P' and thus in practice in the axial direction from the radially outermost end $E_H$ to the radially innermost end $E_B$.

In the embodiment shown in full line in the figures, each of the bearing areas Z comprises a plurality of bearing facets F all generally inclined relative to the reference plane P' and all orthogonal to the axial plane of the assembly passing through the median radius of a bearing area Z of this kind, extending symmetrically to each side of this axial plane, and are of different inclinations relative to the reference plane P', said bearing facets F being in radial sucession on circumferences of different diameter according to their inclination.

In practice each of these bearing facets F forms a simple surface.

In the embodiment shown in FIG. 6 each facet forms a plane surface.

As an alternative, each facet may form a spherical or toroidal surface whose axis, which is in the axial plane of the assembly passing through its intermediate area, either is or is not inclined relative to the axis A' of the bearing ring 16.

In practice, in the embodiment shown, three plane bearing facets FI, FII, FIII are provided in this way for each bearing area Z and in each bearing area Z the bearing facets F of the same rank are on circumferences of the same diameter.

All these bearing facets are inclined in the same direction relative to the reference plane P'.

In practice, they get closer to this reference plane as they get closer to the axis A' of the assembly.

For each bearing area Z the most inclined bearing facet FI is that situated on the smaller diameter circumference and thus terminates at the end $E_B$, the most inclined bearing facet FIII is that situated on the largest diameter circumference and therefore terminates at the end $E_H$, and the intermediate bearing facet FIII has an inclination intermediate that of the other two.

It results from the foregoing that the bearing surface that each of the bearing areas Z offers by virtue of its bearing facets F is generally convex, with its concave side facing towards the reference plane P'.

Another result of the foregoing is that the least inclined bearing facet FIII is situated nearest the ring 17.

In practice in the embodiment shown it is aligned with the annular land 29 formed by the ring 17 where it merges with its axial extension 28.

In practice, the end bearing facets FI, FIII being plane in this embodiment, they form of themselves for each bearing area Z the corresponding end tangential planes $T_B$, $T_H$.

In other words, they are coincident with these end tangential planes $T_B$, $T_H$.

The angle O subtended at the centre of each bearing area Z thus constituted may be relatively small.

For example, it may be in the order of 10°.

Each of the bearing facets F of each bearing area Z extends circumferentially across the full width of the corresponding bearing area.

In practice, their respective inclinations depend on the type of progressive ophthalmic lens in question, that is to say on the specific topography of the progressively variable curvature portion of the semi-finished blank 10 to be processed, just as much as on the range of basic curvatures possible for the latter.

Thus they do not need to be defined more precisely here.

In practice the inside diameter of the axial extension 28 of the ring 17 is substantially equal to the outside diameter of the semi-finished blank 10, being slightly greater than the latter.

When it is engaged with it through its finished face 11, as schematically represented in chain-dotted line in FIG. 5, a semi-finished blank 10 to be processed is thus substantially adjusted in this axial extension 28 of the ring 27 without being clamped in it, however.

As shown, the height of the axial extension 28 of the ring 17 is preferably less than the thickness of the semi-finished blank 10, to facilitate manipulation of the latter.

In practice, the semi-finished blank 10 to be processed carries markers that are not visible in the figures.

In order to install it correctly in the bearing ring 16 in accordance with the invention it is sufficient to make these markers coincide with the markers 30 carried by the latter.

Figure 7:
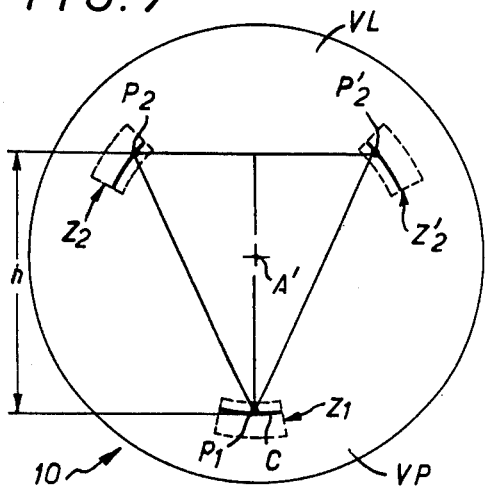
FIGS. 7 and 8 are plan views schematically illustrating the bearing engagement of a semi-finished blank to be processed with a bearing ring of this kind.

As schematically represented in FIG. 7, the semi-finished blank 10 thus fitted by its finished face 11 into the bearing ring 15 in accordance with the invention bears locally through the latter on each of the bearing areas Z provided for this purpose on the bearing ring 16, more precisely on a bearing facet F of the same rank of these bearing areas Z.

In practice, given the markers employed, which are provided for this purpose, it is through its near sight portion VP, more precisely a point of the latter situated on its principal meridian, that the semi-finished blank 10 to be processed bears on the central bearing area Z1 of the bearing ring 16, whereas it is through its far sight portion VL, more precisely two points on the latter situated one on each side of this principal meridian, that is conjointly bears on the lateral bearing areas Z2, Z'2 of this bearing ring 16.

Let P designate the corresponding contact points, P1 for the bearing area Z1, P2 for the bearing area Z2, and P'2 for the bearing area Z'2.

These points P1, P2, P'2 are all on the same circumference C centered on the axis A' of the assembly.

They form the apexes of an isosceles triangle.

Let h be the length of the principal median of this isosceles triangle, that is to say the one which, beginning from the point P1 corresponding to the central bearing area Z1, is perpendicular to the side connecting together the points P2, P'2 corresponding to the lateral bearing areas Z2, Z'2 and thus forms conjointly the corresponding height.

Figure 8:
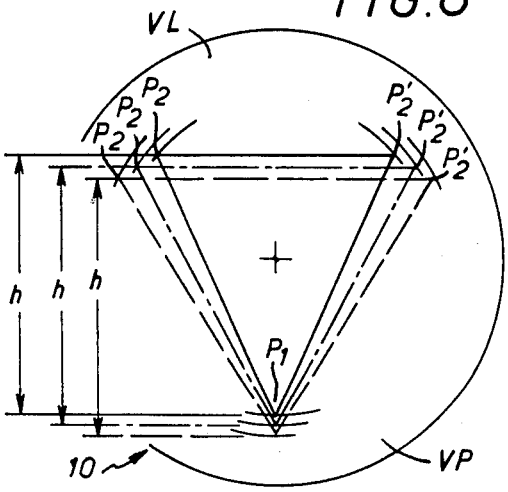

If for the same basic curvature the additional refractive power of the finished face 11 of the semi-finished blank 10 to be processed varies, the points of contact P are displaced radially and circumferentially on the corresponding bearing facet F but, as schematically represented in FIG. 8, the length of the principal median of the isosceles triangle that they form remains substantially constant despite the deformation to which this isosceles triangle is subject.

In FIG. 8, for purposes of clarity, the displacements of these contact points P have been considerably exaggerated.

As indicated above, they are each assumed to rest on the same bearing facet F.

Depending on the basic curvature of the finished face 11 of the semi-finished blank 10 to be processed, it is one or other of the bearing facets F which, for each bearing area Z and according to the disposition previously described, is concerned.

In practice, the same bearing facet F may be suitable for all of a restricted range of different basic curvatures.

This is why a limited number of bearing facets F is sufficient to cover all the ranges of basic curvatures usually employed.

Thus for a given topography of the finished face 11 of the semi-finished blanks 10 to be processed, a single bearing ring 16 is sufficient.

In other words, in accordance with the invention, one bearing ring 16 is sufficient for each type of progressive ophthalmic lens.

When, by virtue of the arrangements previously described, the corresponding semi-finished blank 10 is engaged with its finished face 11 in the bearing ring 16, the assembly is attached to a blocking device in which, by means of the notch 32 provided for this purpose, a low melting point metal is cast into the internal volume delimited by the semi-finished blank 10 and the bearing ring 16.

The required mounting block 15 is thus formed with a defined location and orientation relative to the semi-finished blank 10 to which it adheres, the reference plane P' that the internal face 19 of the ring 17 of the bearing ring 16 forms being coincident with the reference plane P relative to which is defined the orientation of the optical axis A of the semi-finished blank 10.

The axis A' of the bearing ring 16 may then be coincident with this optical axis A.

This is not necessarily so, however.

To the contrary, this optical axis A may be inclined relative to the reference plane P' and thus relative to the reference plane P, if required.

As already indicated above, although in the embodiment shown the bearing facets F employed are plane, they may equally well be curved, that is spherical or toroidal for example, again as already indicated, to compensate for the effect of certain non-linear laws of progression; in the case of spherical or toroidal bearing facets, the radius of the sphere or of the meridian of the torus in practice has a value between that of the radius of the far sight area and that of the radius of the near sight area.

In the alternative embodiment schmatically represented in chain-dotted line in FIG. 6, each of the bearing areas Z comprises a single bearing facet $F_C$ and this is continuously curved from one end $E_B$, $E_H$ to the other.

To simplify the diagram it is assumed in FIG. 6 that the corresponding contour of this single bearing facet $F_C$ is inscribed within the polygonal contour defined by the foregoing plane bearing facets FI, FII, FIII (being in practice tangential to the intermediate bearing facet FII and to the end bearing facets FI, FIII).

However, this is obviously not necessarily the case, this contour being, for example, at least locally higher or lower (as shown for the intermediate bearing facet FII) relative to the foregoing.

The curved single bearing facet $F_C$ thus employed for each bearing area Z may be spherical or toroidal, for example, but not necessarily so.

Be this as it may, its concave side generally faces towards the reference plane P', the planes $T_B$, $T_H$ tangential to its ends $E_B$, $E_H$ forming between them, as previously, a dihedron D.

In other words, it is generally convex, like the assembly formed by the foregoing plane bearing facets FI, FII, FIII.

It is to be understood that the present invention is not limited to the embodiments described and shown, but encompasses any variant execution, in particular with regard to the number of bearing areas used.

In all cases, however, in accordance with the invention the bearing surface that each of these bearing areas offers is generally convex.

Also, although in the foregoing it has been assumed that the progressive surface concerned was symmetrical relative to the principal meridian of the blank processed, this is not necessarily the case, the invention being equally applicable to the case of asymmetric progressive surfaces.

Likewise, this surface is not necessary a convex surface, but may equally well be a concave surface.

Finally, instead of itself constituting the semi-finished blank of a progressive ophthalmic lens, the blank processed may, for example, constitute the semi-finished blank of a mold adapted for molding a progressive ophthalmic lens of this kind.

What I claim is:

1. A bearing ring for semi-finished ophthalmic lens or lens mold blanks having progressive convex faces of different curvature, said bearing ring comprising a plurality of bearing areas for contact with any selected one of a plurality of different semi-finished blanks within a selected range, said bearing areas being circumferentially spaced around an axis, said bearing ring having a reference plane perpendicular to said axis and axially inwardly of said bearing areas, all of said bearing areas being generally inclined relative to said reference plane, each of said bearing areas extending between two bearing areas ends radially and axially offset relative to each other, each of said bearing areas having a median plane containing said axis and extending radially through a middle of said bearing area, planes tangential to respective ends of each of said bearing areas and orthogonal to said medial plane forming an obtuse dihedron having a concave side facing towards said reference plane, each of said bearing areas comprising a plurality of bearing facets for selective contact with a semi-finished blank, all of said bearing facets being generally inclined relative to said reference plane and all being orthogonal to the corresponding median plane, the inclination of each of said bearing facets of each of said bearing areas being different from that of other bearing facets of the same bearing area, said bearing facets being in radial succession on circumferences of different diameter according to their inclination, end bearing facets of each of the bearing areas being coincident with corresponding end tangential planes.

2. A bearing ring according to claim 1, wherein in each of said bearing areas, a most inclined bearing facet is that facet situated on a smallest diameter circumference and a least inclined bearing facet is that facet situated on a largest diameter circumference.

3. A bearing ring according to claim 1, wherein each of said bearing facets forms a simple geometrical surface.

4. A bearing ring according to claim 1, wherein said bearing areas form upper faces of studs projecting radially towards said axis from a single ring arranged annularly of said axis.

5. A bearing ring according to claim 4, wherein said studs are separated from one another by notches.

6. A bearing ring according to claim 4, wherein said studs have bases, and said studs are linked at their bases by a simple collar.

7. A bearing ring according to claim 4, wherein said ring comprises an extension projecting axially relative to said studs and extending annularly around said axis.

8. A bearing ring according to claim 4, wherein said ring comprises, internally, a planar support surface disposed perpendicular to said axis and facing away from said bearing areas and defining said reference plane.

9. A bearing ring according to claim 2, wherein each of said bearing areas has three bearing facets, 10. A bearing ring according to claim 1, wherein said facets of each of said bearing areas intersect on another along generally circumferential ridges.

11. A bearing ring according to claim 1, wherein intersections between adjacent bearings facets of each of said bearing areas comprises stepless discontinuities.

12. A bearing ring according to claim 2, wherein a least inclined bearing facet makes an acute angle with the horizontal and a most inclined bearing facet makes an acute angle with the vertical.

13. A bearing ring according to claim 1, wherein there are three of said bearing areas.

14. A bearing ring according to claim 1, wherein each of said bearing areas subtends an angle with said axis on the order of 10°.

* * * * *